United States Patent [19]

Garabedian et al.

[11] Patent Number: 4,644,906

[45] Date of Patent: Feb. 24, 1987

[54] DOUBLE TUBE HELICAL COIL STEAM GENERATOR

[75] Inventors: George Garabedian, Boston; Robert A. DeLuca, Newton Centre, both of Mass.

[73] Assignee: Stone & Webster Engineering Corp., Boston, Mass.

[21] Appl. No.: 732,369

[22] Filed: May 9, 1985

[51] Int. Cl.[4] ..... F22B 1/02; F22B 37/24

[52] U.S. Cl. ..... 122/32; 122/34; 122/367 R; 165/172

[58] Field of Search ..... 122/32, 34, 1 B, 367 R, 122/367 A, 367 C; 165/132, 172

[56] References Cited

U.S. PATENT DOCUMENTS

| | | | |
|---|---|---|---|
| 3,545,412 | 12/1970 | Kinyon | 122/34 |
| 3,613,780 | 10/1971 | Bruschetti | 165/132 |
| 3,628,507 | 12/1971 | Saporiti | 122/32 |
| 3,662,718 | 5/1972 | Creek | 122/32 |
| 3,812,825 | 5/1974 | Polcer et al. | 122/483 |
| 3,848,572 | 11/1974 | Giardina | 122/32 |
| 3,888,212 | 6/1975 | Wolowodink | 122/34 |
| 3,907,026 | 9/1975 | Mangus | 165/70 |
| 4,337,827 | 7/1982 | Jabsen | 165/172 |
| 4,342,362 | 8/1982 | Belleli | 165/158 |
| 4,446,820 | 5/1984 | Jansing | 122/32 |
| 4,554,889 | 11/1985 | Lilly | 112/34 |

FOREIGN PATENT DOCUMENTS 1177533 1/1970 United Kingdom .

*Primary Examiner*—Henry C. Yuen

*Attorney, Agent, or Firm*—Hedman, Gibson, Costigan & Hoare

[57] ABSTRACT

A double tube helical coil steam generator is provided in which a multiplicity of inner tubes conducting water are individually surrounded by outer tubes containing liquid metal as a heat transfer agent. The double tubes form into helical coils, providing a large surface area while conserving space. Immersion of the double tube helical coil in hot liquid metal, e.g., from the core of a nuclear reactor, causes efficient transfer of heat across the liquid metal in the outer tube to the water in the inner tube, creating superheated steam, which can be cycled to a turbine and converted to electrical power. The efficiency, reliability and safety of the multiple double tube design of the steam generator obviates the necessity of many secondary heat removal and emergency components in addition to conserving space and material.

22 Claims, 7 Drawing Figures

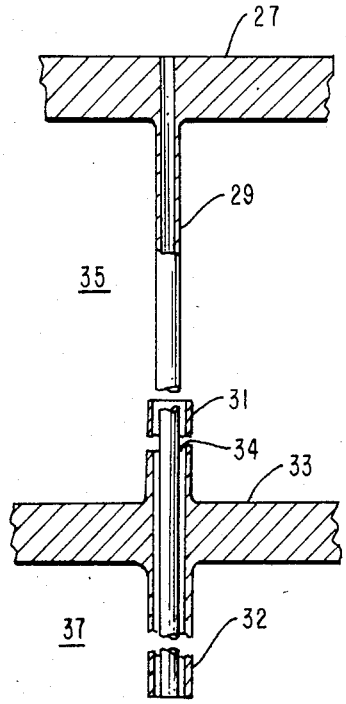
FIG. 3
FIG. 4
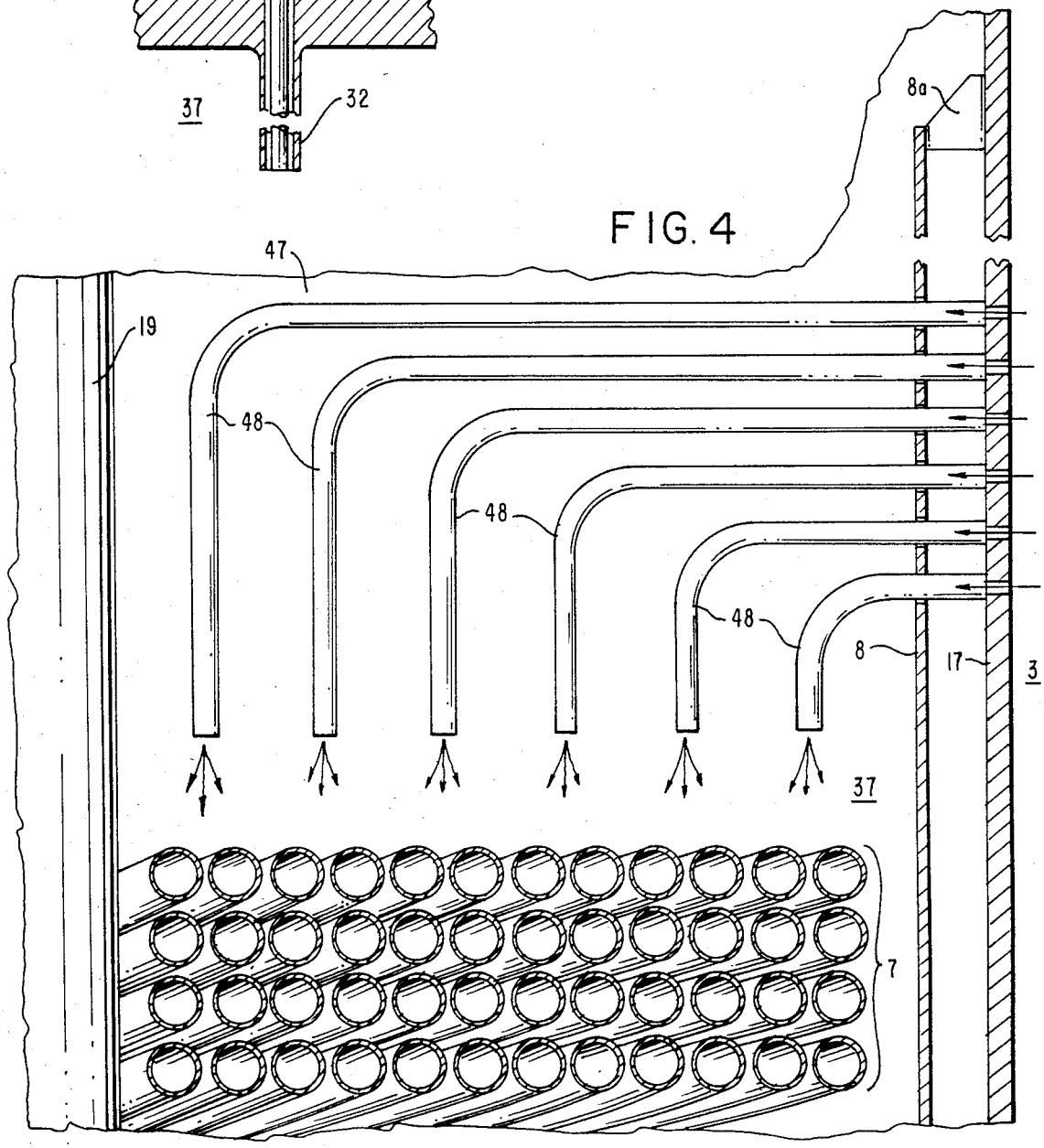

DOUBLE TUBE HELICAL COIL STEAM GENERATOR

FIELD OF THE INVENTION

This invention relates to a steam generator heated by liquid metal, such as may be used in nuclear energy power plants. More particularly, the invention relates to a steam generator for using the heat from a nuclear reactor coolant system to generate high pressure steam and provide improved fail-safe conditions for a reactor coolant system.

BACKGROUND OF THE INVENTION

Nuclear reactors cooled by a liquid metal such as sodium are well known, and the circulating hot liquid metal coolant has been utilized for generating power by heat transfer from the liquid metal to water, which in turn is converted to high pressure steam. The steam is then cycled to a turbine-generator power conversion system for generating electricity.

A major drawback and a safety problem in such steam generators is the need to protect the system against the violent metal-water reactions that may result from a leak in the liquid metal and/or water circulation systems. Should the liquid metal reactor coolant come into direct contact with steam or water leaking out from the steam generator tube, a violent chemical reaction occurs with a corrosive byproduct (e.g., NaOH) and free hydrogen. Conventional reactor-power plant systems employ an intermediate liquid metal heat exchange circuit to protect the reactor core in the event of a leak. Although from the standpoint of efficiency, design simplicity and conservation of physical space and other resources it would be highly advantageous to eliminate such intermediate systems, a steam generator design of exceptional reliability or with special protective features such as a double tube wall design would be required.

A drawback of known double tube steam generator systems is their inefficiency in transferring heat from the liquid metal coolant to water. Prior art steam generators of double wall construction have relied on inert gas as a heat transfer medium, however an inert gas barrier is extremely inefficient for this purpose. U.S. Pat. No. 3,545,412, U.S. Pat. No. 3,613,780 and U.S. Pat. No. 3,907,026, for example, show apparatuses wherein closely placed tubes containing liquid metal or water are surrounded by inert gas, or wherein water tubes are run through a sleeve containing inert gas separating the water and liquid metal coolant. Other prior art duplex tube steam generators have used bonded tubes or duplex tubes with mercury as the intermediate heat transfer agent. Bonded tubes can experience difficulties associated with loss of contact stress due to thermal aging. Duplex tubes with mercury pose a safety problem for the reactor core, because typical liquid metal coolants, i.e., sodium, react with the mercury to form an amalgam.

Furthermore, conventional steam generators are large and bulky due to use, typically, of straight tube design. As a result, integration of a steam generating system with the reactor is often complex and costly. Furthermore, such steam generator designs present difficulties in locating a failed tube and in accommodating tube-to-tube and tube-to-shell temperature gradients.

SUMMARY OF THE INVENTION

Accordingly, it is a primary object of this invention to provide a novel and highly reliable liquid metal steam generator particularly well suited for application in a nuclear power plant.

It is a further object to provide a liquid metal steam generator having improved reliability and safety over prior art designs.

It is a further object of this invention to provide a modular steam generator which has an integral barrier between the hot liquid metal and water systems which does not require a pump, separate piping or an intermediate heat exchanger.

It is a further object of this invention to provide a steam generator with an efficient heat transfer path between the liquid metal coolant and water.

All of the aforementioned disadvantages of the prior art are addressed, and the aforementioned objects attained, by the present invention. The steam generator disclosed herein utilizes stagnant (non-circulating) liquid metal as a heat transfer medium, which is confined to the annulus area of a compact co-axial double tube assembly. Water is conducted through the inner tube, and the double tube assembly is immersed in hot liquid metal coolant. The liquid metal in the annulus area acts as an efficient heat transfer agent between the reactor coolant and the water.

A multiplicity of double tube assemblies are bundled together and wound in a helical coil. The helical coil design results in a compact unit, which additionally provides great surface area for heat transfer between the liquid metal coolant and the water, across the stagnant liquid metal barrier in the annular gap. The large number of double tube assemblies provides increased safety in operation, because in the event of an inner tube failure, the metal-water reaction is confined to the annulus area of the duplex tube. The liquid metal in the annular gap is the same as or compatible with the liquid metal coolant, therefore an outer tube failure has no hazardous effects.

The steam generator of the present invention may be viewed as the juxtaposition of three closed systems: a circulating water system, a stagnant liquid metal barrier system, and a circulating liquid metal coolant system.

The circulating water system begins at a water inlet that may be connected to an outside feedwater source. From the inlet, the water proceeds via a multiplicity of water-carrying tubes into the body of the steam generator, each of the tubes joins a separate outer tube to form a concentric double tube assembly, and bundles of such double tubes are wound in a helical coil. By heat transferred from the outside of the double tube across the annular gap, the water is converted to superheated steam which exits the system at a steam outlet, which may in turn be connected to a turbine generator for the production of electricity.

The stagnant liquid metal barrier system begins at a disengaging chamber, which is completely closed within the steam generator during normal operation of the system. Water-carrying tubes enter the disengaging chamber, where the tubes join with the enclosing outer tubes of the concentric double tube assemblies. The annular gap formed by the joining of inner (water-carrying) and outer tubes is in open communication with the disengaging chamber. The multiplicity of double tubes, as mentioned above, forms a helical heat exchange coil. The double tube continues from the helical coil to a closed disengaging chamber where the outer tubes of the double tube assemblies end, and the inner tubes continue on to a steam outlet. The initial disengaging chamber for the outer tube may be the same as or different from the terminal disengaging chamber for the outer tube. Part of the volume of the annular gap between the inner tube and the outer tube of each double tube assembly is filled with a liquid metal which effectively transfers heat from the outside of the double tube assembly to the inner (water-carrying) tube. The volume of the disengaging chamber(s) and any unfilled volume of the annular gap is filled with an inert gas, such as argon. The circulating liquid metal coolant system begins at a hot liquid metal coolant inlet which may be connected to the cooling system of a nuclear reactor. Hot liquid metal enters through the hot liquid metal coolant inlet and is directed into contact with the double tube helical coil. Heat from the liquid metal coolant is transferred across the barrier liquid metal in the annular gaps of the double tubes to the water carried in the inner tubes, creating superheated steam. After transferring heat to the double tube helical coil, cold liquid metal coolant flows away from the coil and is directed out of the steam generator via a cold liquid metal coolant outlet, which may be connected to the coolant reservoir of a nuclear reactor.

The double tube design of the steam generator allows the closest possible contact between the three closed systems while still providing a barrier between the liquid metal coolant and the water. Using liquid metal as a heat transfer agent is much more efficient than inert gas. Using a multiplicity of double tube assemblies increases the heat transfer surface area in direct contact with the hot liquid metal coolant, while dramatically reducing the volume of liquid metal coming into contact with water, in the event of a leak in an inner tube. Using a helical coil configuration conserves space and inherently accommodates thermal gradients while permitting unobstructed flow of the water/steam system.

Generally, the steam generator comprises a vessel that is subdivided into upper (hot) and lower (cold) liquid metal plenums. In operation, hot liquid metal flows into the steam generator upper plenum, flows through a distributor inlet above the helical coil, flows downward over the coil, transferring heat through the barrier liquid metal (in the double tube annular gap) to the water flowing within the inner tube of the coil. The cooled liquid metal exits into the steam generator lower plenum and is discharged from the steam generator vessel. Optionally, an electromagnetic or centrifugal pump is connected to the lower plenum, e.g., in the core of the steam generator (see FIG. 1), and a portion of the liquid metal coolant reaching the lower plenum passes into the pump and is discharged at high velocity through a pump eductor back to the reactor. The remaining liquid metal coolant in the lower plenum enters the eductor and passes, mixed with the flow from the electromagnetic pump discharge, through a diffuser to convert the velocity head to a pressure head, and thence to the reactor inlet.

BRIEF DESCRIPTION OF THE DRAWINGS

FIG. 3 is an enlarged detail of a portion of the disengaging chamber (35) of FIG. 1, showing the mating of the inner and outer tubes to form the double tube section.

FIG. 4 is an enlarged detail of the coolant distributor (47) of FIG. 1.

DETAILED DESCRIPTION OF THE PREFERRED EMBODIMENT

The steam generator of the present invention is essentially a heat exchanger having a water/steam circuit enveloped in a stagnant barrier/heat transfer system which may be contacted with hot media for transferring the heat from the media to the water for the production of steam. Although the safety and efficiency of the steam generator of the present invention make it particularly suitable for cooling the hot liquid metal coolant from a nuclear reactor, the invention will be useful in many other applications where efficient exchange of heat between incompatible liquid media is desired. In the following detailed description, the steam generator of the present invention will be described as if it were connected to the circulating liquid metal coolant system of a nuclear reactor. A nuclear reactor is chosen as the most preferred embodiment and for ease of explanation, however the following description should not be construed as a limitation of the scope of this invention.

Figure 1:
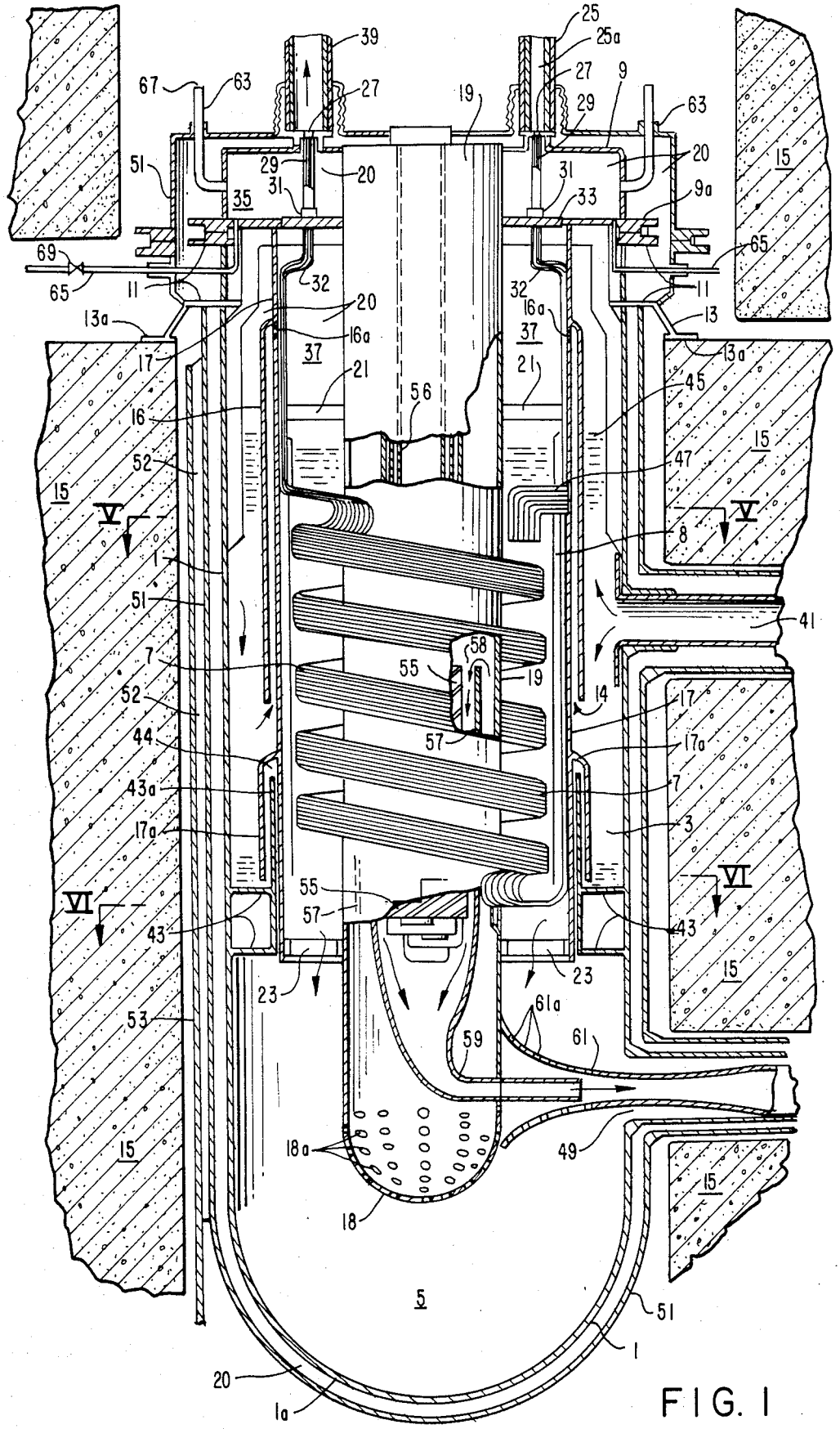
FIG. 1 is a longitudinal cross-sectional elevational view of a steam generator module of the invention.

Referring to FIG. 1, the steam generator of the invention is comprised essentially of a vertical, cylindrical steam generator vessel (1) closed at its lower end, subdivided into two main chambers, an upper plenum (3) and a lower plenum (5). The upper plenum (3) houses a helical coil bundle (7). In general operation, hot liquid media introduced into the upper plenum (3) exchanges its heat to water circulating through the helical coil bundle (7), then the cooled liquid media flows to the lower plenum (5), from which it is ultimately discharged.

Preferably, the cylindrical steam generator vessel (1) has a closed, rounded lower end (1*a*). The top of the steam generator vessel (1) is capped by a closure plate (9) which is bolted at a bolting flange (9*a*) to a supporting ring girder (11). A conical skirt (13) is welded to the ring girder (11) and is bolted at its base ring (13*a*) to the supporting concrete enclosure (15), thereby providing primary support for the entire apparatus.

The top closure plate (9) supports a cylindrical support shroud (17) and a core cylinder (19). The support shroud (17) further subdivides the upper plenum (3) of the steam generator vessel (1). The support shroud (17) also encloses a number of helical coil bundles (7). Each helical coil bundle (7) is supported within the cylindrical support shroud (17) by a system of coil supports (not shown) attached to upper helical coil bundle supports (21) and lower helical coil bundle supports (23).

The circulating water system within each helical coil tube bundle (7) begins at a feedwater inlet nozzle (25). A large diameter feedwater inlet tube (25*a*), leading from an outside feedwater source, ends at an inner tube plate (27) at the bottom of the feedwater nozzle (25). A multiplicity of water-carrying inner tubes (29) are connected to the bottom of an inner tube sheet (27). Each one of the inner tubes (29) is joined with a co-axial outer tube

(31) to form a concentric double tube assembly (32), best seen in FIG. 3. The outer tubes (31) are connected to an outer tube sheet (33), which tube sheet (33) is welded at its outer edge to the top closure (9) in the plane of the bolting flange (9a), and it is welded at its inner edge to the core cylinder (19). The welded components, top closure (9), core cylinder (19) and outer tube sheet (33), create a closed disengaging chamber (35) into which the outer tubes (31) open. In preferred embodiments, the disengaging chamber (35) is further subdivided with vertical walls spaced radially around the circumference of the top closure, which separate the disengaging chamber (35) into discrete wedge-shaped compartments, with (most preferably) one such compartment for each nozzle and its associated tubing. Such an arrangement, with a separate disengaging chamber compartment for every nozzle and set of tubes, makes continued use of the steam generator easier in the event of a tube failure in one of the sets of tubes.

The multiplicity of double tube assemblies (32) extend into the inner cavity (37) of the upper plenum (3), which inner cavity (37) is enclosed by the support shroud (17). Bundles of 10–100 double tube assemblies (32) are wound in a helical coil (7) within the inner cavity (37). Preferably, as shown in FIG. 1, the double tube assemblies (32) will extend from the outer tube sheet (33) downward to a point near the end of the support shroud (17) in order to form an upwardly spiraling helical coil bundle (7). A multiplicity of double tube assemblies (32) extend upward to meet the outer tube sheet (33) at the top of the helical coil bundle (7), where the outer tubes (31) terminate within a disengaging chamber (35), and the inner tubes (29) continue through the disengaging chamber (35) to terminate at the inner tube sheet (27). Steam generated within the inner tubes (29) exits the steam generator through a steam outlet nozzle (39), which in turn may be connected to a turbine generator for the production of electricity.

The steam generator vessel (1) is provided with at least one liquid metal coolant inlet (41) connected to the circulating coolant system around the nuclear reactor core. A diaphragm (43) between the upper plenum (3) and the lower plenum (5), and a gas seal (44) between a diaphragm male portion (43a) and a support shroud female portion (17a), prevent liquid metal coolant entering the upper plenum (3) from passing directly to the lower plenum (5).

Hot liquid metal coolant entering upper plenum (3) rises to a level (45) above a coolant distributor (47) connected to the support shroud (17), as best seen in FIG. 4. This coolant distributor (47) provides the only opening for liquid metal flow between the upper plenum (3) and the inner cavity (37). Vent holes (16a) are provided in the support shroud (17) near the junction with the outer shell (16) to prevent a gas bubble from forming under the outer shell (16). The coolant distributor (47) directs hot liquid metal coolant evenly over all of the helical coil tube bundles (7). Heat from the liquid metal coolant is exchanged through the outer tubes (31) to the inner tubes (29) through a barrier liquid metal contained within the annular gap of the double tube assemblies (32). Water in the inner tubes (29) is converted to superheated steam. Cooled liquid metal coolant proceeds downward past the helical coil bundles (7), past the end of the support shroud (17) cylinder and into the lower plenum (5).

The lower plenum (5) has at least one outlet (49), through which cooled liquid metal coolant is returned to the nuclear reactor.

A guard vessel (51) completely surrounds the steam generator vessel (1) and serves as a containment vessel. Its primary function is to contain any liquid metal coolant or radioactive gas that might leak through the wall of the steam generator vessel (1) or any of its connected structures (i.e., closure plate (9), tube sheet (33), liquid metal inlet (41), liquid metal outlet (49)). The free volumes (20) above the liquid metal coolant level (45) within the upper plenum (3) and the inner cavity (37), in the disengaging chamber (35), and enclosed by the guard vessel (53) are all filled with an inert cover gas such as argon to prevent oxygen contamination of the liquid metal coolant.

Each feedwater inlet nozzle (25) is preferably oriented 180° from its corresponding steam outlet nozzle (39). There are preferably six inlet and six outlet nozzles. Radial partition plates (not shown) may be inserted between the feedwater inlet nozzles and steam outlet nozzles and welded around all edges to form a plurality of disengaging chambers (35). This serves to make each multiplicity of tube assemblies (32) associated with each pair of feedwater inlet and steam outlet nozzles (25, 39) completely discrete from the other sets of double tube assemblies (32).

Although in FIG. 1 only one set of feedwater inlet and steam outlet nozzles (25, 39), one set of double tube assemblies (32), and one helical coil bundle (7) are shown, it will be understood that a set of double tubes and at least one helical coil bundle will be present for each pair of inlet and outlet nozzles.

Each helical coil bundle (7) consists of a multiplicity of co-axial double tube assemblies (32). A large number, for example 10–100 inner tubes (29) will emanate from each feedwater inlet nozzle (25), extend across the disengaging chamber (35) and form co-axial double tube assemblies (32) at the outer tube sheet (33). As mentioned above, the double tubes (32) continue, most preferably, to the bottom of the inner cavity (37) where bundles of approximately 10–100 double tubes (32) are wound to form an upwardly spiraling helical coil (7). It is most preferred that, in all, approximately 240 co-axial double tube assemblies (32) will be helically wound to form twelve individual sets of 20 identical helices of about five and one-half turns each. The diameters of each helix may vary in order to fill the inner cavity (37) between the support shroud (17) and the core cylinder (19). For example, the pitch diameter of the outer set of helices may be 17 feet, 9.75 inches, with the pitch diameter of the inner set of helices being 11 feet, 10.25 inches, and the pitch diameter of the remaining helices progressing by 6.5 inches. The axial pitch of all of the helices may be 2.375 inches, bringing the overall tube bundle length to 21 feet, 9.25 inches.

Figure 2:
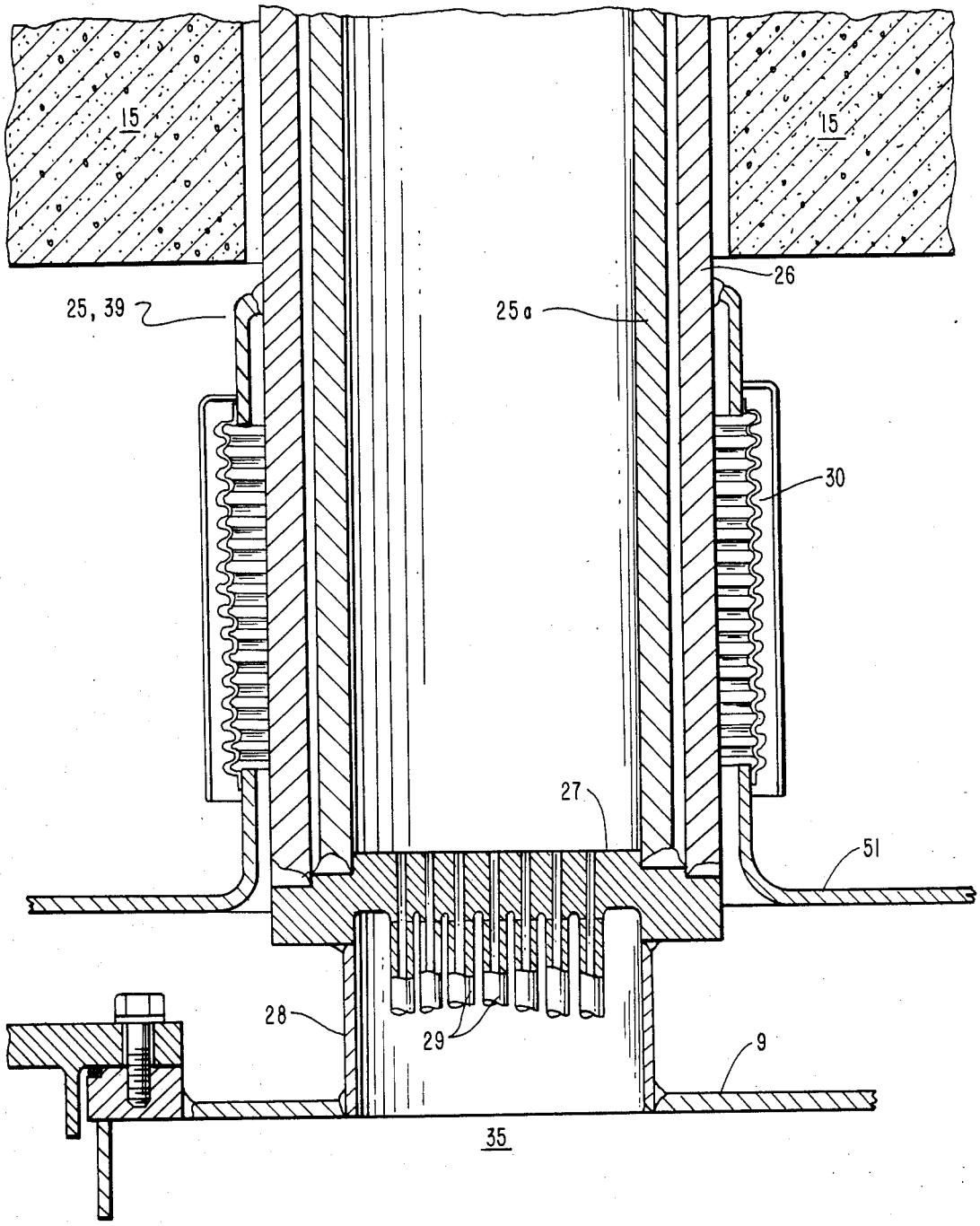
FIG. 2 is an enlarged detail of a typical nozzle (25) or (39) in FIG. 1 for the feedwater or steam.

Referring to FIG. 2, each of the feedwater inlets (25) consists of an inlet tube neck (28) welded to inner tube sheet (27) to which 10–60, preferably about 40, water-carrying inner tubes (29) are connected. The neck (28) is attached to the top closure plate (9) and opens into disengaging chamber (35). Concentric vertical nozzle tubes (25a) and (26) are welded to the opposite side of tube sheet (27) from inlet tube neck (28). Vertical nozzle tubes (25a) and (26) pass vertically upward through any overhead shielding (15) and are attached to a feedwater source.

Most preferably, a pipe, e.g., a schedule 120 pipe, is welded to the inner vertical nozzle tube (25*a*) near its upper extremity, and another pipe, e.g., a schedule 120 pipe, is welded to the outer vertical nozzle tube (26). These pipes are also concentric. The purpose of this concentric construction is to contain released fluid from the inner vertical nozzle tube (25*a*), or the inner pipe, in the event of a leak. The penetration through the guard vessel (51) is sealed with a bellows connection (30).

Each of the steam outlet nozzles (39) are constructed in an identical manner to the feedwater inlet nozzle (25) described above. Most preferably, there are six feedwater and six steam discharge nozzles.

Referring to FIG. 3, each inner tube (29) is attached to the inner tube sheet (27). Each outer tube (31), ending at a disengaging chamber (35), is mated with an inner tube (29) and passes through the outer tube sheet (33). The double tube assembly (32) continues into the inner cavity (37) of the upper plenum (3) and eventually forms a helical coil (7). The concentric arrangement of the inner tube (29) with the outer tube (31) defines an annular gap (34) which will be filled for at least part of the length of double tube assembly (32) with a liquid metal. The stagnant liquid metal in annular gap (34) may be the same as or different from the liquid metal coolant which circulates through the upper and lower plenums (3, 5) of the steam generator vessel (1). Sodium is the preferred liquid metal. Other liquid metals and fluids may be utilized, as long as they are compatible with the liquid metal coolant introduced into the steam generator vessel (1). As used herein, "compatible" signifies that the liquid metal in the annular gap efficiently transfers heat between the liquid metal coolant and the water in the inner tubes (29) but which, in the event of a leak in an outer tube (31), will not react violently with the liquid metal coolant. Preferably the heat transfer liquid metal in the annular gap and the liquid metal coolant are the same. Most preferably the liquid metal coolant will be sodium and the heat transfer liquid metal will be sodium, or a sodium-potassium mixture. Use of such a liquid metal in the annular gap will serve to prevent the occurance of "hot spots" in the inner tubes (29).

Each outer tube (31) is welded to the outer tube sheet (33), which lies in the plane of the top closure bolting flange (9*a*). This tube sheet is welded to the bolting flange (9*a*) along its outer edge and is welded at its inner edge to the core cylinder (19). This joins the outer tube sheet (33) to the structure of the top closure plate (9), to form disengaging chamber (35).

Although the precise dimensions of the aforementioned tubing (29, 31) are not critical, it is preferred to use a large number of double tube assemblies (32), each having a relatively small diameter. By way of illustration, a feedwater inlet (25) will open through concentric vertical tubes (25*a*) and (26) having dimensions of, e.g., 17.125 inches inside diameter, 20.25 inches outside diameter and 21.75 inches inside diameter, 25.75 inches outside diameter, respectively, leading to an inner tube sheet (27), from which 40 inner tubes (29) having a 1.25 inch outside diameter emanate. The inner tubes (29), 1.25 inch outside diameter by 0.17 inch thickness, join outer tubes (31) having inside diameter 1.615 inch and outside diameter 1.75 inch. In the annular gap (34), the inner tube may be preferably provided with a 0.125 inch diameter rod, helically wound at a 1.25 inch pitch, brazed to its outer surface to form a spacer across the annular gap (34). The spacer design within the annular gap (34) permits free expansion of the liquid metal.

The annular liquid metal functions as a barrier between the water flowing through the inner tubes (29) and the liquid metal coolant flowing over the outer tubes (31). A detection system monitors the level of liquid metal in the annular gap (34) to detect any breach of the integrity of an outer tube (31). In addition, a detection system, such as a hydrogen monitor, monitors the inert gas space (20) above the stagnant liquid metal to monitor any leakage of water/steam into the annular gap (34) or disengaging chamber (35).

FIG. 4 provides details of the coolant distributor (47). The unit is preferably comprised of a multiplicity of curved tubes (48) which are mounted on the support shroud (17) and provide communication between the upper plenum (3) and the inner cavity (37). Each column of curved tubes (48) has several rows of tubes which uniformly direct the coolant through the support shroud (17) and evenly over the helical coil bundles (7). In preferred embodiments, a baffle plate (8), supported by brackets (8*a*) attached to the inside surface of the support shroud (17) and between the double tubes (not shown), will be placed adjacent the helical coil bundles (7) to prevent the incoming liquid metal coolant from bypassing the coils and falling straight down to the lower plenum.

Referring again to FIG. 1, the core cylinder (19) may house a discharge pump (55), which is supported within the core cylinder (19) by an inner pump support cylinder (56). The core cylinder (19) terminates inside the lower plenum (5) with a rounded end (18) having numerous perforations (18*a*) through which liquid metal coolant entering the lower plenum (5) may pass. A discharge pump (55) inducts cooled liquid metal coolant from the lower plenum (5) through the perforations (18*a*). The liquid metal is inducted through the upper intake (58) of the pump (55) and discharged under pressure through discharge nozzle (59) through outlet (49), directing cooled liquid metal coolant back to the nuclear reactor.

Further embodiments may also include a jet eductor (61) as shown in FIG. 1, having perforations (61*a*), through which cooled liquid metal coolant may pass.

Figure 5:
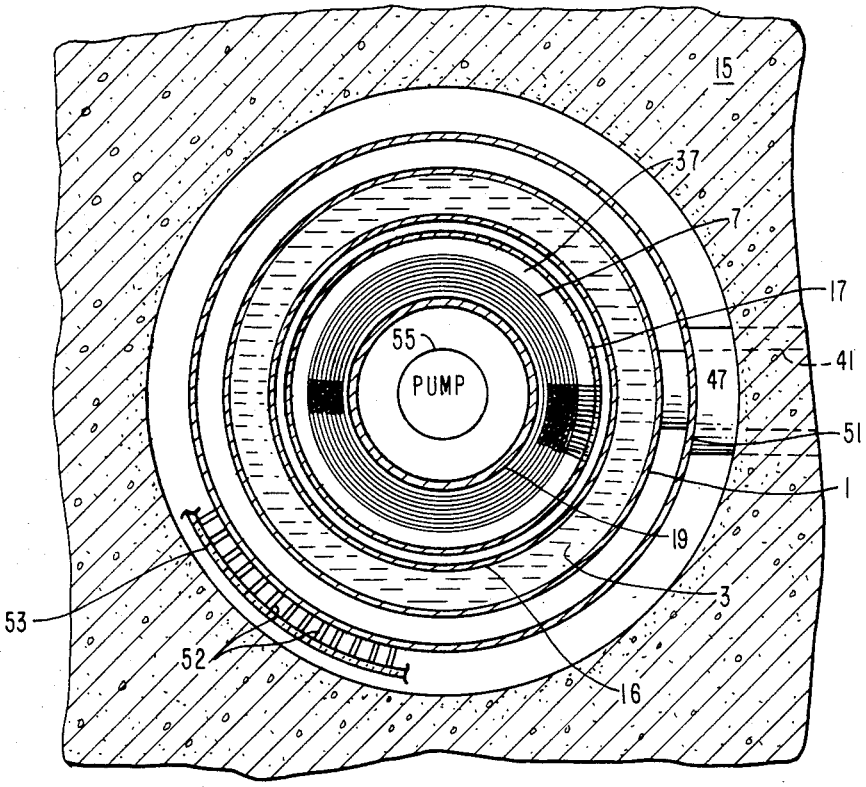
FIG. 5 is a sectional plan view of the steam generator taken across line V—V in FIG. 1.
Figure 6:
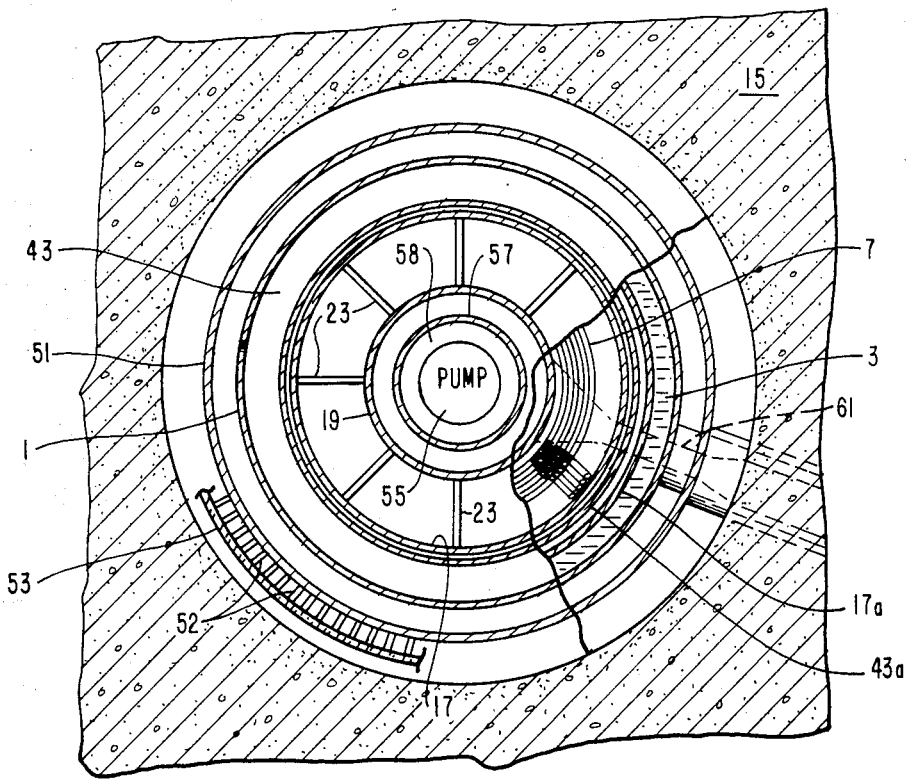
FIG. 6 is a sectional plan view taken across line VI—VI in FIG. 1.

FIGS. 5 and 6 provide cross-sectional views of the modular steam generator illustrated in FIG. 1 and show the successive concentric chambers formed by the particular construction of the steam generator. The drawings show that the steam generator module is completely surrounded by the supporting substratum (15). A partial representation of an insulation shroud (53) and vanes (52), which may be used for decay heat removal and are more fully discussed below, are supported on the outside of the guard vessel (51). The guard vessel (51) encloses the steam generator vessel (1). Immediately inside the steam generator vessel (1) is the upper plenum (3), into which hot liquid metal coolant is introduced via an inlet (41), shown in dashed lines.

In FIG. 5, the support shroud (17) and its outer shell (16) are seen to be the inner boundary of the upper plenum (3). The coolant distributor (47) provides communication, across the support shroud (17), between the inner cavity (37) and the gap between the outer shell (16) and the support shroud (17). Within the inner cavity (37) are the helical coils (7), located under the array of tubes comprising the coolant distributor (47). The inner boundary of the inner cavity (37) is the core cylinder (19). A centrally mounted pump (55) is located within the core cylinder (19).

In FIG. 6, further details of the construction of the lower portion of the steam generator are seen. A portion of this cross-sectional view shows the diaphragm male portion (43*a*) enclosed by the support shroud female portion (17*a*) and the support shroud (17), which provide a gas seal described previously, which separates the upper and lower plenums. The rest of FIG. 6 represents a section taken under the level of the helical coil bundle (7) ahd shows lower helical coil bundle supports (23), between which liquid metal coolant flows (after passing over the helical coils) to reach the lower plenum (5). Also illustrated are the core cylinder (19), and outer pump support cylinder (57), the pump intake channel (58) and the centrally mounted discharge pump (55).

Preferred materials for the steam generator assembly are 9 Cr—1 Mo or 2¼ Cr—1 Mo for the helical coils, the disengaging chamber and the associated structures which are welded to such assemblies. The material for the steam generator vessel is preferably 316 SS, up to the mating flange with the disengaging chamber. The guard vessel is preferably 304 SS or 316 SS.

Temperature transients originating in the reactor vessel are mitigated in the steam generator module by means of the hot liquid metal coolant plenum (upper plenum (3)), in which the liquid metal coolant mixes prior to entering the inner cavity (37) containing the helical coil bundles (7). Temperature transients caused by malfunction of the steam generator are mitigated by the cold liquid metal coolant plenum (lower plenum (5)) of the module. The mitigating effect of the upper and lower plenums results in less severe thermal transients for the primary reactor circulation pump and for the liquid metal coolant returning to the reactor core.

Decay heat removal is accomplished by utilizing a portion of the helical coils for this purpose. A separate reliable source of water is provided to the coils. The outlet from these coils is connected to a local natural draft cooling tower where steam is condensed and returned as cooled condensate to the coils. On scram, the steam generators are removed from the operating feedwater/steam circuit and connected to a naturally circulated water system, dedicated to core decay heat removal. Water enters the feedwater inlets of the steam generators at 420° F. and leaves the steam outlets as 855° F. superheated steam. The steam flows to a natural draft cooling tower where it is condensed and the condensate cooled to 420° F. The cooling tower height is sufficient to create the driving force required to cause the cooled water to circulate naturally through the coils within the steam generators by virtue of the density differential between the steam condensate and the cooled water.

An alternate or backup means of decay heat removal is provided by attachment of fins to the exterior of the guard vessel and utilizing air cooling for heat removal.

As an illustration, the outside surface of the guard vessel (51) is covered with vertical fins or vanes (52) which are, for example, 8 inches deep and ¼ inch wide, and are welded to the surface of the guard vessel (51) on a 3¼ inch pitch. A ¼ inch thick cylindrical insulation shroud (53) is attached to the outer boundary of the fins (52), to support a 3 inch thick layer of fiberglass thermal insulation (not shown). The insulation shroud (53) projects 7 feet below the guard vessel lower end (1*a*) and terminates at a 3 inch thick, steel clad fiberglass blanket (not shown) that insulates the bottom of the well in the concrete substrate (15) in which the steam generator is mounted. Outside ambient air is piped to the lower end of the shroud from an air shaft and flows upward by chimney effect through the passages formed by the fins and exhausts to a stack.

In the event that the main coolant circulating pump is not available, provision can been made for assuring a direct and low pressure drop pathway for natural circulation of the liquid metal coolant when the air cooling system is employed for decay heat removal. For this eventuality, the gas seals (44) separating the upper and lower plenums (3, 5) at the bottom area of the helical coil bundles (7) are purged, thereby allowing a free flow of coolant from the hot plenum area (3), down through the annular opening and into the lower plenum (5) where it returns to the reactor via the jet eductor outlet (61). In the event an eductor is not utilized in the design, the flow would enter the pump suction through the perforations (18*a*), pass through the pump and return to the reactor via the pump discharge outlet (59).

To illustrate operation of an embodiment utilizing sodium as coolant, with reference to FIG. 1, sodium at approximately 950° F. enters the steam generator vessel (1) via a sodium inlet line (41). The hot sodium mixes in the upper plenum (3) of the steam generator vessel (1) and flows into the annular opening (14) between the outer shell (16) and the support shroud (17). The sodium is uniformly distributed through the support shroud (17) and over the helical coil bundles (7) by means of a sodium distributor (47). Sodium flows downward over the helical coils (7), exchanging its heat across the double tube annular gap to the water/steam flowing within the inner tubes (29) of the double tube assemblies (32). The flow path of the sodium is such that a low pressure drop occurs for the cooled sodium flow (less than 3 psi). The cooled sodium exits the bottom of the helical coil bundle (7) and mixes within the lower plenum (5) at the bottom of the steam generator vessel (1). A small portion of this sodium is entrained in the jet jump eductor (61) and returns to the reactor via the vessel discharge line (49). The balance of the sodium flow enters the pump intake suction (58) through perforations (18*a*) at the bottom portion of the core cylinder (18). Perforated openings (18*a*) provide a uniform and well mixed sodium flow pattern within the lower plenum (5). The discharge pump (55) raises the pressure of the liquid sodium and discharges it to the reactor via the eductor and discharge line.

To illustrate the water/steam circuit, with reference to FIG. 1, water enters the top of the steam generator vessel (1) at six separate nozzles (25). The water enters the inner tube (29) of the double tube assemblies (32) and flows through the inner tubes (29) of the helical coil bundles (7), picking up heat through the sodium in the annular gap (34) from the hot sodium coolant cascading downward over the coils (7) in the inner cavity (37). Sufficient heat transfer area is provided by the helical coil bundles (7) to boil the water and superheat the resulting steam within the coils. Superheated steam then exits from six steam nozzles (39) at the top of the steam generator vessel (1).

Primary coolant flow past the steam generator coils can be terminated by increasing gas pressure within the inner cavity (37) and lowering the sodium level below the level of the sodium distributor (47).

In the event of a rupture of one of the inner tubes (29), the escaping steam and feedwater, and the hydrogen and sodium hydroxide from the resulting reaction with the small amount of sodium in the annular gap (34)

within outer tube (31), all flow to the disengaging chamber (35) at either end of the double tube assembly (32) in which the rupture occurred.

Referring to FIG. 1, each disengaging chamber (35) has connections (63) to a steam and hydrogen disposal system, and separate connections (65) to a sodium disposal system (26). Each pipe (63) to the steam and hydrogen disposal system is sealed with a 45 psia rupture disc (67) and each pipe (65) to the sodium disposal system has a closure valve (69) which is closed while the steam generator is operating. As pressure within a disengaging chamber (35) rises to the 10% tolerance set point of the rupture disc (67), the blowout of the rupture disc allows the escaping steam and hydrogen to vent to a disposal system. Only a low pressure buildup occurs: Since the quantity of sodium in the annular gap (34) is small, only a small fraction of this sodium initially is exposed to the water/steam released from the breach in the inner tube (29), and the rupture disc (67) limits the peak pressure in the disengaging chamber (35). An important feature of this invention is that through utilization of a multiplicity of duplex tube assemblies, the flash discharge from a water tube rupture is very small compared with prior art systems, and shut-down procedures in the event of such a rupture may be instituted before an emergency situation develops. Closure of the steam and feedwater nozzles associated with the tube bundle containing the failed tube terminates the source of water/steam flowing through a failed inner tube. Consequently, immediate closure of all water/steam flow paths to and from the steam generator is not required for a single water tube rupture, and the reactor system may be shut down without experiencing a severe temperature transient.

After the feedwater line and the steam line leading to the double tube assembly (32) in which the rupture occurred have been valved off and the pressure within the disengaging chamber (35) has been reduced to atmospheric, the valves (69) in the sodium drain lines (65) are opened and any sodium remaining in the disengaging chambers (35) is drained to a sodium disposal system. All sodium piping is heat traced.

After the disengaging chambers (35) has been drained, the blowout rupture discs (67) are replaced and all sodium remaining in the double tube assembly (32) is sent to the sodium disposal unit by pressuring the disengaging chamber (35) with hot argon gas. Following this, the failed tube (29) is plugged and the tube cluster is flushed with hot sodium to the sodium disposal unit to remove the sodium hydroxide resulting from the sodium-water reaction.

The annular gap is then refilled with hot sodium to the operating level and the cluster is returned to service.

Figure 7:
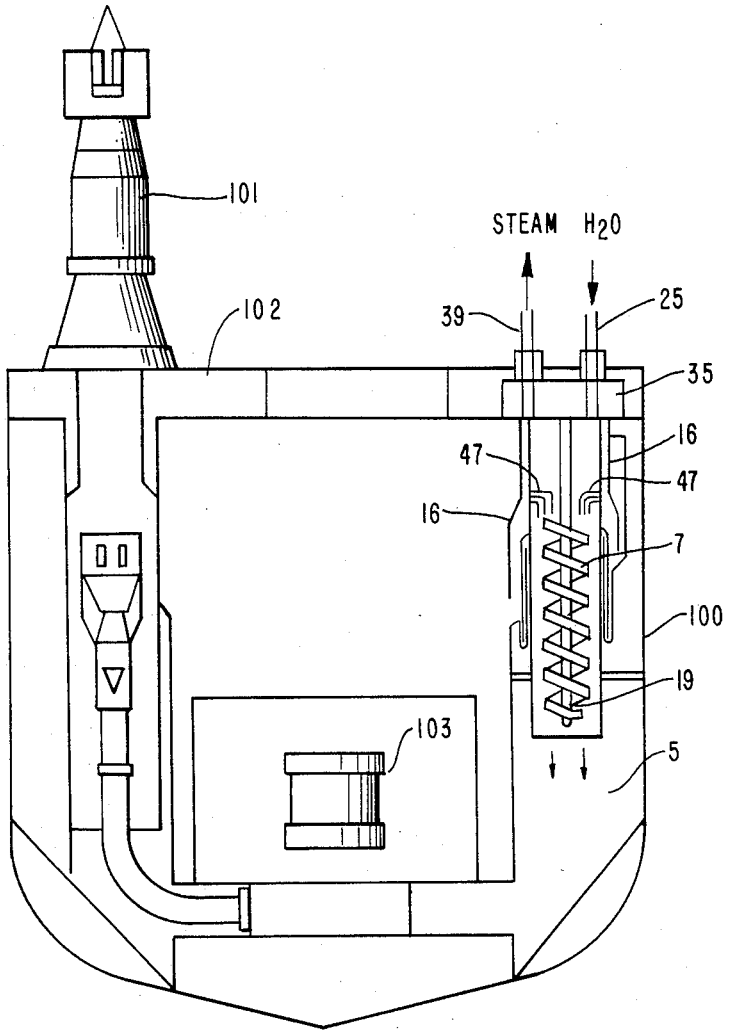
FIG. 7 is a longitudinal cross-sectional elevational view of an alternate embodiment of the steam generator of this invention.

The double tube helical coil steam generator of this invention may also be directly used in the pool or integrated type of liquid metal cooled reactor. This type of reactor features a multiplicity of low pressure drop (approximately 3 psi) heat exchangers, which are immersed in a pool of liquid metal coolant within the reactor vessel. This application of the helical coil design is effective because the helical coil has approximately the same pressure drop as an intermediate heat exchanger. Such an embodiment is diagramed in FIG. 7.

For this application, the helical coil steam generator assembly is not enclosed in a steam generator vessel and guard vessel, as in the modular steam generator illustrated in FIG. 1. Rather, the apparatus is enclosed by the main reactor vessel (100). The centrally mounted pump ((55) in FIG. 1) may be retained or, as is the practice for this type of reactor, a circulating pump (101) is located at a separate area of the reactor vessel. In this type of embodiment, a multiplicity of helical coil bundles (7) are provided. The helical coils (7) may be circular in the plan view or, as is the practice in many steam generator designs, may be rectangular in plan. The central support for the helical coils (7) is provided by a core cylinder (19). The disengaging chamber (35) is located within the top head area (102) of the vessel (100). The pump (101) is separately located within the reactor vessel. Both feedwater (25) and steam (39) nozzles are located at the top of the vessel head (102).

The operation of the double tube helical coil steam generator in the pool reactor is similar to that described above for the modular steam generator system. Liquid metal coolant exiting the reactor core (103) enters under the steam generator shroud (16) into the area of the coolant distributors (47) and is distributed evenly over the helical coil bundles (7). The liquid metal coolant then flows by gravity downward past the helical coils (7) into the bottom pump plenum (5). The pump (101) circulates the liquid metal coolant through the reactor core (103) to complete the coolant flow circuit.

All of the patents mentioned above are incorporated herein by reference. From the foregoing diclosure, variations and modifications will be readily apparent to persons skilled in this art. However, all such obvious variations are intended to be within the scope of the invention as defined by the appended claims.

What is claimed is:

1. A steam generator comprising a container having a closed lower end, divided into longitudinally arranged sections including an uppermost disengaging chamber, an upper plenum, and a lower plenum, said upper plenum being above said lower plenum and containing a multiplicity of double tube helical coils, wherein each of said double tube helical coils is comprised of an inner tube individually enclosed for at least a portion of its length by an outer tube to form a double tube portion and thereby define an annular gap which is outside said inner tube but enclosed by said outer tube;

said inner tube being attached at one end to a feedwater inlet, and said inner tube being attached at the other end to a steam outlet;

said outer tube being in open communication at both ends with said disengaging chamber;

said double tube portion being in the configuration of a helix for part of its length;

said upper plenum having no communication with said disengaging chamber and having restricted communication with said lower plenum such that liquid metal entering the upper plenum and flowing to said lower plenum closely contacts at least a portion of the double tube helical coils; and said annular gap being at least partially filled with liquid metal.

2. A steam generator as defined in claim 1, wherein said upper plenum is provided with a liquid metal inlet and said lower plenum is provided with a liquid metal outlet, said inlet and outlet providing communication to the outside of the container.

3. A modular steam generator comprising a cylindrical vessel having a closed lower end, divided into at least three longitudinally arranged sections including an uppermost disengaging chamber, an upper plenum, and a lower plenum, said upper plenum being above said lower plenum and containing a plurality of double tube helical coils, wherein said cylindrical vessel is closed at its upper end by a closure plate having a plurality of feedwater inlet nozzles and steam outlet nozzles, the number of feedwater inlet nozzles being equal to the number of steam outlet nozzles, and each of said nozzles providing open communication to the outside of the cylindrical vessel;

each double tube helical coil is comprised of 1–20 double tube bundles, each double tube bundle being comprised of 10–100 inner tubes individually enclosed for at least a portion of their length in an outer tube to form a double tube portion and thereby define an annular gap which is outside said inner tube and enclosed by said outer tube;

said inner tubes being attached at one end to a feedwater inlet and attached at the other end to a steam outlet nozzle;

said outer tubes being in open communication at both ends with said disengaging chamber;

said annular gap being at least partially filled with liquid metal;

each double tube portion extending from its end closest to the feedwater inlet connection of its inner tube downwardly to the bottom of said upper plenum, then spiraling upwardly in a helical configuration for at least a portion of the length of said upper plenum, the remainder of said double tube portion extending upwardly to its end closest to the connection of its inner tube with a steam outlet nozzle;

said upper plenum having at least one liquid metal inlet in open communication with the outside of the cylindrical vessel, said upper plenum having no communication with said disengaging chamber and having restricted communication with said lower plenum such that liquid metal entering the upper plenum and flowing downwardly to said lower plenum closely contacts at least a portion of the double tube helical coil;

said lower plenum having at least one liquid metal outlet in open communication with the outside of the cylindrical vessel;

said double tube helical coil being enclosed by a cylindrical shroud extending the length of the upper plenum, the portion of said upper plenum outside said shroud being separated from said lower plenum by a diaphragm;

the portion of said upper plenum outside said shroud being in communication with the portion enclosed by said shroud by means of a plurality of liquid metal distributor openings in said shroud, which liquid metal distributor openings are above the helix-shaped portion of said double tube helical coil.

4. A steam generator as defined in claim 3, wherein the helical coils are fabricated from a low alloy steal selected from 2¼ Cr—1 Mo or 9 Cr—1 Mo, and the cylindrical vessel is fabricated from high alloy steal selected from 304 SS or 316 SS, and the structural connections wherein low alloy steal and high alloy steal are joined are accomplished without a bimetallic weld.

5. A steam generator as defined in claim 3, wherein said disengaging chamber is subdivided into discrete sections, each section corresponding to an inlet or outlet nozzle and enclosing a separate double tube bundle, such that the double tube portion annular gaps of each double tube bundle are in communication with only one disengaging chamber section at either end of the double tube portion, and such that isolation of an individual double tube bundle by disconnecting its inlet and outlet nozzles and sealing this corresponding disengaging chamber sections does not influence the operation of the rest of the steam generator.

6. A steam generator as defined in claim 3, wherein said cylindrical vessel further contains a centrally located discharge pump having intake means in communication with said lower plenum and directing its discharge through an opening in said cylindrical vessel

7. A steam generator as defined in claim 6, wherein said opening is located in the upper plenum.

8. A steam generator as defined in claim 6, wherein said opening is located in the lower plenum.

9. A steam generator as defined in claim 6, wherein said discharge pump directs its discharge through said liquid metal outlet.

10. A steam generator as defined in claim 6, wherein the cylindrical vessel is substantially completely enclosed in a guard vessel.

11. A steam generator as defined in claim 6, wherein said inner tubes have an outside diameter of about 1.25 inches and said outer tubes have an inside diameter of about 1.615 inches and an outside diameter of about 1.75 inches.

12. A steam generator as defined in claim 6, wherein a spacer is provided between said inner and outer tubes.

13. A steam generator as defined in claim 6, wherein a spacer is provided between said inner and outer tubes.

14. A steam generator as defined in claim 6, further including a jet eductor located in said lower plenum having intake means positioned to receive both liquid metal flowing from the upper plenum and liquid metal being discharged by said discharge pump, and directing its discharge through said liquid netal outlet.

15. A steam generator as defined in claim 6, wherein detection means are in communication with said disengaging chamber which are capable of detecting failure of an individual inner tube within a double tube portion or failure of an individual outer tube.

16. A steam generator as defined in claim 15, wherein said detection means for failure of an inner tube include a hydrogen detector probe in the disengaging chamber and wherein said detection means for failure of an outer tube include a liquid level or temperature probe monitoring the height or temperature of liquid metal in the double tube portion of said helical coils.

17. A steam generator as defined in claim 15, further including blow-out seals in communication with the volume of the disengaging chamber which will rupture at the increase in pressure within the disengaging chamber caused by the reaction in one double tube portion between the liquid metal in the annular gap and water leaking from a failed inner tube in said double tube portion.

18. A steam generator as defined in claim 15, wherein said disengaging chamber is in communication with a drain line equipped with a valve closure, said drain line providing communication between the disengaging chamber and disposal means for solid or liquid material entering the disengaging chamber.

19. A steam generator as defined in claim 6, which further comprises a liquid metal distributor comprising a plurality of tubes which pass through said support shroud and provide communication between said upper plenum and the area enclosed by the support shroud, said distributor being located on the support shroud at a level and in a configuration to ensure even distribution over the double tube helical coil of any liquid metal passing from said upper plenum through said distributor.

20. A steam generator as defined in claim 19, which further includes one or more gas seals between the diaphragm and the support shroud such that when the seals are breached, liquid metal entering the upper plenum may flow directly to the lower plenum, and wherein said gas seals and said liquid metal distributor provide the only means of communication between the upper plenum and the lower plenum.

21. A steam generator as defined in claim 20, wherein said cylindrical vessel is substantially completely enclosed in a guard vessel, which guard vessel is equipped with vertical fins attached to the outer surface of the guard vessel and extending for at least a major portion of the length of the guard vessel, said fins providing a heat transfer surface providing heat removal from the guard vessel and being capable of directing air flow vertically along the surface of said guard vessel and its fins.

22. A steam generator as defined in claim 21, wherein a layer of insulating material surrounds the guard vessel, supported at the ends of said vertical fins.

* * * * *